US005983878A

United States Patent [19]

Nonaka et al.

[11] Patent Number: 5,983,878

[45] Date of Patent: Nov. 16, 1999

[54] ENGINE CONTROL

[75] Inventors: Kimihiro Nonaka; Toshiaki Sato, both of Hamamatsu, Japan

[73] Assignee: Sanshin Kogyo Kabushiki Kaisha, Hamamatsu, Japan

[21] Appl. No.: 08/971,868

[22] Filed: Nov. 19, 1997

[51] Int. Cl.[6] ..... F02D 41/14

[52] U.S. Cl. ..... 123/687; 123/679; 123/689; 123/694

[58] Field of Search ..... 123/679, 687, 123/689, 693, 694, 695, 696

[56] References Cited

U.S. PATENT DOCUMENTS

| | | | |
|---|---|---|---|
| 3,915,135 | 10/1975 | Kushida et al. | 123/694 |
| 4,150,562 | 4/1979 | Nielsen | 123/694 X |
| 4,156,404 | 5/1979 | Anzai | 123/694 |
| 4,171,690 | 10/1979 | Hosaka et al. | 123/694 |
| 4,446,833 | 5/1984 | Matsushita et al. | 123/435 |
| 4,461,260 | 7/1984 | Nonaka et al. | 123/478 |
| 4,768,485 | 9/1988 | Brandner et al. | 123/694 |
| 5,230,322 | 7/1993 | Curran et al. | 123/694 |
| 5,261,376 | 11/1993 | Kato et al. | 123/479 |
| 5,322,047 | 6/1994 | Oliu et al. | 123/694 X |
| 5,408,872 | 4/1995 | Nonaka | 73/118.2 |
| 5,546,919 | 8/1996 | Iida et al. | 123/682 |
| 5,586,524 | 12/1996 | Nonaka et al. | 123/73 A |
| 5,588,416 | 12/1996 | Suzuki et al. | 123/684 |
| 5,655,500 | 8/1997 | Kato | 123/336 |
| 5,682,867 | 11/1997 | Katoh et al. | 123/676 |
| 5,687,700 | 11/1997 | Kato | 123/688 |
| 5,694,909 | 12/1997 | Kato | 123/672 |
| 5,697,353 | 12/1997 | Katoh et al. | 123/679 |

*Primary Examiner*—Tony M. Argenbright
*Attorney, Agent, or Firm*—Knobbe, Martens, Olson & Bear LLP

[57] ABSTRACT

The present invention is an engine control for an internal combustion engine having at least one combustion chamber and an air/fuel charging system for delivering an air and fuel charge to the combustion chamber for combustion therein. The control includes an oxygen sensor associated with the combustion chamber, the sensor providing feedback data based upon the air/fuel ratio of the charge supplied to the combustion chamber. The control also includes at least one sensor for sensing a condition other than the air/fuel ratio in the combustion chamber which affects the output of the oxygen sensor. The control adjusts the air/fuel ratio of the charge delivered to the combustion chamber towards a target value based upon the output of the oxygen sensor, the control arranged to adjust the target value based upon the output of the at least one sensor sensing an operating condition other than the air/fuel ratio.

12 Claims, 5 Drawing Sheets

ENGINE CONTROL

FIELD OF THE INVENTION

The present invention relates to an engine control, and more particularly to an engine control including an air/fuel feedback control and sensor arrangement.

BACKGROUND OF THE INVENTION

Various control methodology and systems have been employed in conjunction with internal combustion engines so as to improve their performance, particularly in the areas of fuel economy and exhaust emission control. One of the more effective types of controls is a so-called "feedback" control. With this type of control, a basic air/fuel ratio is set for the engine. Adjustments are then made from the basic setting based upon the output of a sensor that senses the air/fuel ratio in the combustion chamber in order to bring the air/fuel ratio into the desired range.

Normally, the type of sensor employed for such feedback controls is an oxygen ($O_2$) sensor which provides an electrical output signal. Generally, when the output signal voltage is high, little oxygen is present in the exhaust thus indicating that a charge which was rich in fuel was been supplied. On the other hand, when the output signal voltage is low, substantial amounts of oxygen are present in the exhaust, thus indicating that a charge which was rich in air was been supplied.

This type of sensor is normally associated with a waveforming circuit which manipulates the output of the sensor to indicate an "ON" signal when the voltage of the output signal exceeds a reference voltage (i.e. a signal which results when the supplied charge is rich in fuel). On the other hand, the circuit manipulates the signal to indicate that the sensor is "OFF" when the voltage of the output signal does not exceed the reference voltage (i.e. a signal which results when the supplied charge is rich in air).

The control operates on a feedback-control principle, continuously making corrections to accommodate deviations from the desired air/fuel ratio. Adjustments are made in stepped intervals until the sensor output goes to the opposite sense from its previous signal. For example, if the mixture is too rich in fuel (i.e. the sensor signal is "ON"), then lean adjustments are made until the mixture strength is sensed to be lean (i.e. the sensor signal turns "OFF"). Adjustments are then made back into the rich direction in order to try to maintain the desired ratio.

Most commonly, the oxygen sensor is of the type which utilizes inner and outer platinum or platinum coated electrodes. The use of platinum as the electrode portions of the sensor is advantageous for serving the purposes of the electrical activity associated with the electrodes. On the other hand, the platinum acts as a catalyst, catalyzing exhaust. For example, oxygen remaining in the exhaust may be catalyzed with carbon monoxide at the platinum electrode interface, creating carbon dioxide. While the effect of the platinum in improving exhaust gas emissions may be advantageous, the oxygen content of the gas being sensed can be affected to a degree which causes the sensor to provide inaccurate data, causing the control to adjust the air/fuel ratio erroneously.

For example, while the actual oxygen content of the exhaust system may correspond to an air rich air/fuel charge such that the actual signal from the sensor should indicate that the sensor is "OFF," the above-described effect may cause the sensor to indicate little oxygen is present (i.e. as if a fuel rich charge had been supplied) by an "ON" signal. In that instance, the feedback control is arranged to adjust the air/fuel ratio in the fuel-rich direction in response to the "ON" signal even though the mixture is already fuel-rich.

It is, therefore, a principal object of this invention to provide an improved feedback control system for an engine, the feedback control including an oxygen sensor.

SUMMARY OF THE INVENTION

The present invention is an engine control for an internal combustion engine having at least one combustion chamber and an air/fuel charging system for delivering an air and fuel charge to the combustion chamber for combustion therein.

The control includes an oxygen sensor associated with the combustion chamber, the sensor providing feedback data based upon the air/fuel ratio of the charge supplied to the combustion chamber. In addition, the control includes means for sensing a condition other than the oxygen content which affects the output of said sensor such that it does not provide a signal indicative of the actual air/fuel ratio.

The control is arranged to change an air/fuel ratio of the air and fuel charge supplied to the combustion chamber based upon the output of the oxygen sensor as corrected by an output supplied by the means for sensing.

In a preferred embodiment, the means for sensing comprises an engine temperature sensor providing engine temperature data to the control. In addition, an intake air temperature sensor provides intake air temperature data to the control.

In the preferred embodiment, the control provides a target air/fuel value and adjusts this target value based upon the intake air and engine temperature data received from the sensors. The output of the oxygen sensor is then utilized to determine whether the air/fuel ratio of the charge supplied is at the target value.

Further objects, features, and advantages of the present invention over the prior art will become apparent from the detailed description of the drawings which follows, when considered with the attached figures.

BRIEF DESCRIPTION OF THE DRAWINGS

FIG. 5(*b*) illustrates the watercraft illustrated in FIG. 5(*a*) in a planed condition.

DETAILED DESCRIPTION OF THE PREFERRED EMBODIMENTS OF THE INVENTION

The present invention is an engine control including a feedback control for adjusting the air/fuel ratio of the charge supplied to the engine, and a sensor for providing feedback control data to the feedback control.

Figure 1:
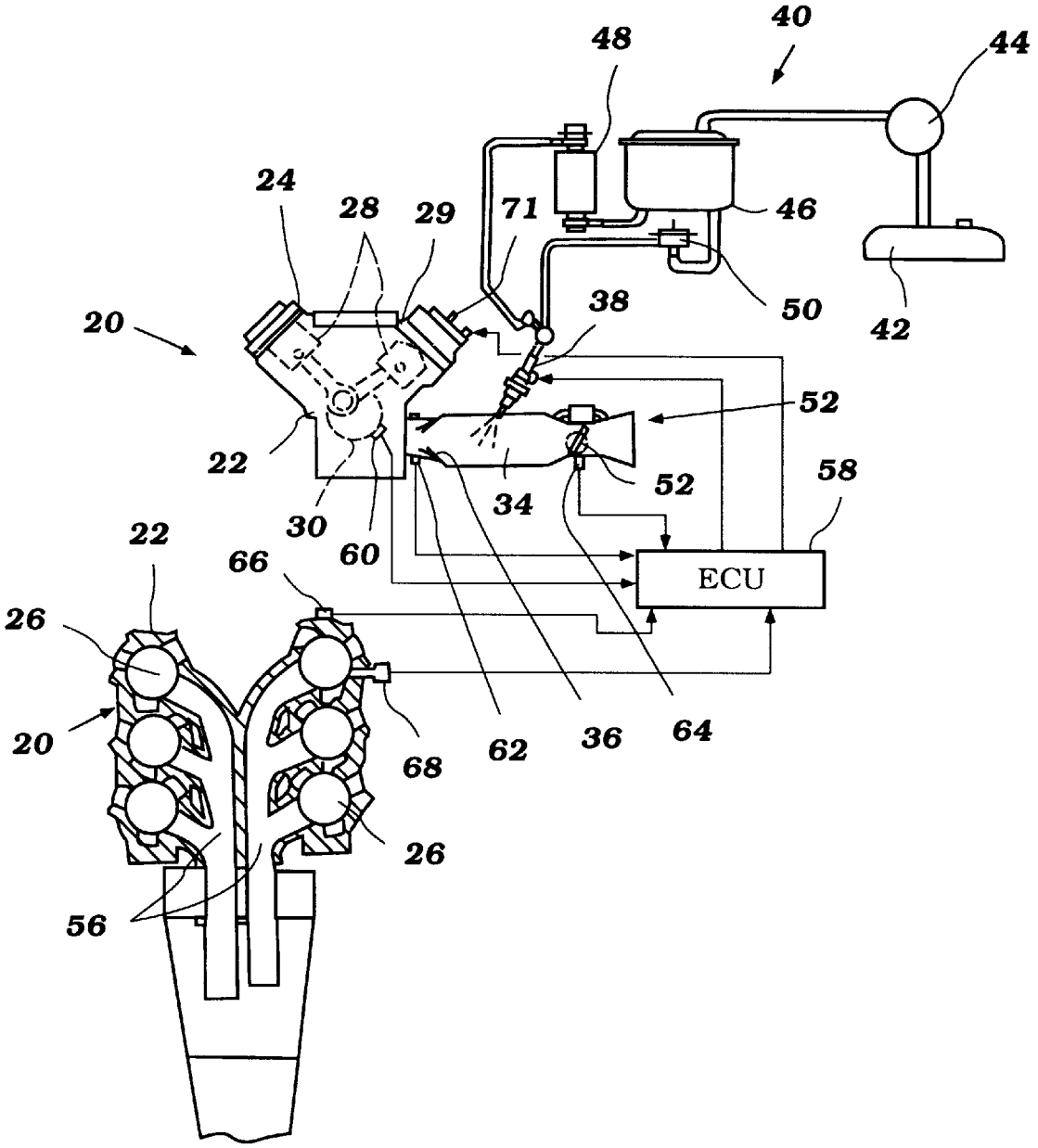
FIG. 1 diagrammatically illustrates the interrelationship of various sensors of a control system of the present invention with an engine having a fuel supply and exhaust system.

FIG. 1 illustrates an engine 20 with which the control and sensor arrangement of the present invention is useful. The engine 20 illustrated is of the six-cylinder "V"-type, operating on a two-cycle crankcase compression principle. Although this particular cylinder configuration is illustrated, it will be apparent to those skilled in the art how the invention may be employed with engines having other numbers of cylinders and other cylinder orientations. As will also be apparent to those skilled in the art, certain facets of the invention may also be employed with rotary type engines or those operating on four-cycle principles.

The engine 20 includes a cylinder block 22 cooperating with a pair of cylinder heads 24 to define two cylinder banks. Each cylinder bank contains three cylinders 26. A piston 28 reciprocates in each cylinder, each piston connected by means of a connecting rod to a crankshaft 30. The crankshaft 30 is, in turn, journalled for rotation within a crankcase chamber in a suitable manner. The crankcase chamber is formed by the cylinder block 22 and a crankcase cover member positioned at a bottom end of the engine, as is well known to those skilled in the art.

As is typical with two-cycle crankcase compression engine practice, the crankcase chamber is divided into compartments, the compartments associated with each of the cylinders 26 sealed relative to each other in an appropriate manner. A fuel-air charge is delivered to each of the crankcase chambers by an induction system 32.

As also illustrated in FIG. 1, the induction system 32 includes an intake passage 34. Air is drawn through an opening into the intake passage 34. The intake passage 34 leads to intake ports formed in the crankcase cover member. Reed-type check valves 36 are provided in each intake port for permitting the charge to be admitted to the individual crankcase chambers when the pistons 28 are moving upwardly in the cylinder 26. These reed-type check valves 36 close when the piston 28 moves downwardly to compress the charge in the crankcase chambers, as is well known in the art.

Fuel is added to the air flowing through the intake passage 34 by a suitable charge former. As illustrated in FIG. 1, this charge former comprises a fuel injector 38. The fuel injector 38 is preferably of the electrically operated variety. That is, the fuel injector 38 is provided with an electric solenoid that operates an injector valve so as to open and close and deliver high-pressure fuel directed toward the intake port.

Fuel is supplied to the fuel injector 38 under high pressure through a fuel supply system, indicated generally by the reference numeral 40 in FIG. 1. This fuel supply system 40 includes a fuel supply, such as fuel in a fuel tank or reservoir 42. The tank 42 may be positioned remotely from the engine 20.

Fuel is pumped from the tank 42 by means of a low pressure pump 44, which may be diaphragm, electrically or otherwise operated. The fuel is pumped from the tank 42 through a filter (not shown) and thereon into a vapor separator 46. The separator 46 is arranged to separate and vent excess vapor from the fuel.

Fuel is drawn from the separator 46 and delivered through a high pressure fuel line or rail to the injector 38 by a high pressure fuel pump 48. Fuel which is delivered to the fuel rail but not delivered by the injector 38 is preferably routed throu1gh a return line back to the separator 46. A pressure regulator 50 is provided along the return line for maintaining the high fuel pressure within the fuel rail.

Means are provided for controlling the rate of air flow through the intake passage 34. Preferably, this means comprises a throttle valve 52. This valve 52 is preferably remotely operated by an operator of the engine 20.

It should be understood that a separate intake passage 34 and corresponding throttle valve 52 and injector 38 are preferably provided corresponding to each cylinder 26.

At least one ignition element, such as a spark plug 54, is provided for igniting the air/fuel charge supplied to each cylinder 26. The spark plug 54 is fired by a capacitor discharge ignition system as is well known in the art.

When the spark plug 54 fires, the air/fuel charge in the cylinder 26 ignites and expands, driving the piston 28 downwardly. The combustion products are then discharged through exhaust ports formed in the cylinder block 22. These exhaust gases flow through the port into a common exhaust passage 56 corresponding to each bank. These passage 56 lead to a suitable exhaust discharge, as is known in the art.

Though not described in detail herein, the engine 20 preferably includes a cooling and/or lubricating system of a type known in the art.

In accordance with the present invention, the engine includes a control for controlling one or more of the various engine functions or features. Referring still to FIG. 1, this control includes an electronic engine control unit (ECU) 58. This ECU 58 receives data from one or more sensors, as described in detail below, and controls various functions of the engine based upon this data.

A crankshaft angle sensor 60 provides crank angle position and speed of rotation data to the ECU 58. An intake air temperature sensor 62, illustrated as positioned in the intake passage 34, provides intake air temperature data to the ECU 58. A throttle angle position sensor 64 provides data to the ECU 58 regarding the position of the throttle valve 52. A temperature sensor 66 is also mounted to provide data to the ECU 58 regarding the temperature of the cylinder block 22.

These sensors 60,62,64,66 are illustrated schematically in FIG. 1, their types and construction being well known to those skilled in the art.

In addition, a combustion condition sensor 68 is provided for providing combustion condition feedback data to the ECU 58. This sensor 68 is preferably an oxygen ($O_2$) sensor arranged to sense exhaust generated by the combustion of the air/fuel charge in at least one cylinder 26.

Figure 2:
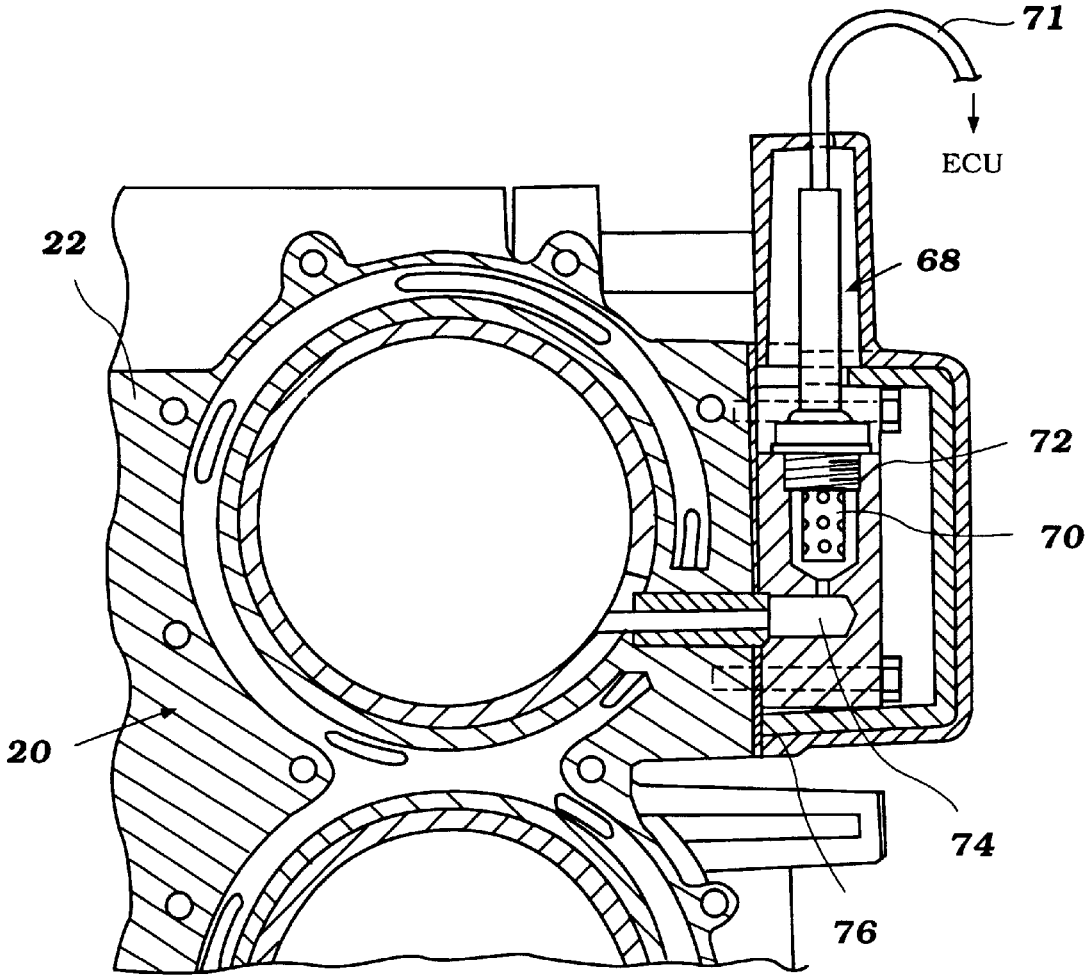
FIG. 2 is a cross-sectional side view of a portion of the engine illustrated in FIG. 1, illustrating a sensor for use with the control system.

This sensor 68 is illustrated in more detail in FIG. 2. As illustrated therein, the sensor 68 has a sensing portion 70 mounted within a fitting 72. The fitting 72 has a threaded connection for engagement with the sensor 68.

The fitting 72 is connected to the engine block 22, such as by bolts. The fitting 72 defines a chamber 74 which is in communication with one of the cylinders 26 of the engine 20 via a passage 76. The sensing portion 70 of the sensor 68 extends into the chamber 74 within the fitting 72.

The sensor portion 70 is preferably formed as well known in the art. As an example, the sensor portion 70 preferably includes at least one platinum-plated electrode, one of which may be a platinum-plated glass tube having a hollow center. In this type of sensor 68, an electrical heater extends into the a hollow center of the sensor along a centerline thereof and communicates with the ECU 58 through a shielded conductor 78. The sensor 68 may comprises other sensor types having other constructions, as known to those skilled in the art.

The sensor 68 provides an output signal to the ECU 58 which is indicative of the oxygen content in the exhaust gas, and thus provides an indication of the air/fuel ratio of the charge being supplied to the engine 20.

As illustrated, the sensor 68 is positioned so as to communicate directly with a single cylinder 26 through the wall of the cylinder. However, the sensor 68 may be arranged to communicate with the exhaust passing through the exhaust passage leading from the cylinder or the common exhaust passage 56.

As described above, the ECU 58 is arranged to control various engine functions. For example, among other things, the ECU 58 controls the firing of the spark plugs 54. In addition, the ECU 58 controls the fuel injector 38, setting both the time and duration of the fuel injection thereby. The ECU 58 may also control the fuel pump(s) 44,48, and a pump associated with a lubricating and/or coolant system.

The ECU 58 may include a memory containing maps for control during certain phases of non-feedback control. These maps preferably also include data regarding the amount of fuel required for each cylinder for sensed engine running conditions. This data may be based on either fuel volume or duration of injection timing.

The ECU 58 sets basic fuel injection among and timing determined by engine speed and load, and once the system is operating and the sensor 68 is at its operating temperature, the system shifts to a feedback control.

Figure 3:
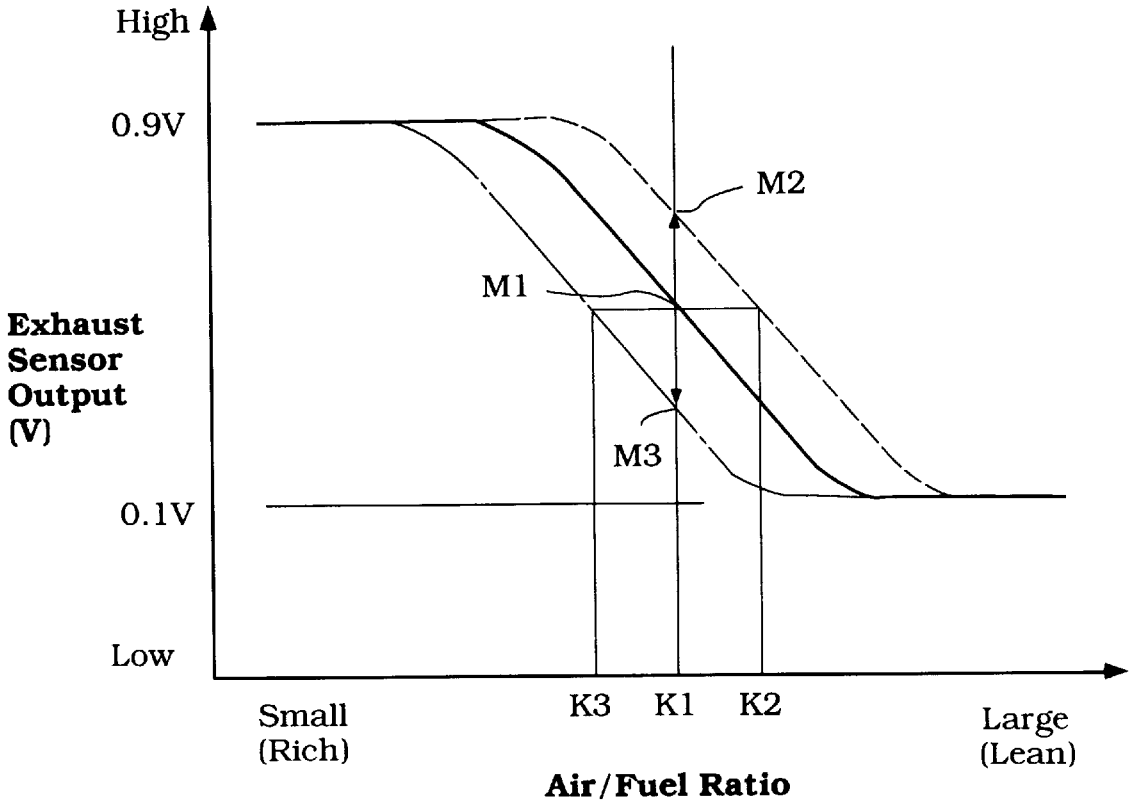
FIG. 3 is a graph which illustrates exhaust sensor output versus air/fuel ratio.

In accordance with the present invention, the ECU 58 makes adjustments to the air/fuel ratio dependent upon the output of the sensor 68 during the feedback control mode. FIG. 3 graphically illustrates sensor output as it relates to air/fuel ratio. As may be seen, when large amounts of air are supplied to the engine 20 in relation to fuel (i.e. the air to fuel ratio is greater than stoichiometric or there is "excess" air) then the mixture is said to be lean. In this instance, the fuel is generally all burned with excess oxygen remaining, and the sensor output is low, such as 0.1 V. When small amounts of air are supplied to the engine 20 in relation to fuel (i.e. the air to fuel ratio is less than stoichiometric or there is insufficient air) then the mixture is said to be rich. In this instance, the fuel is generally not all consumed since there is insufficient oxygen, and the sensor output is large, such as 0.9 V.

As is well known in the art, this signal may be processed by a wave-shaping circuit (not shown) which causes the resultant signal from the sensor 68 to be "ON" or "OFF" instead of a varying voltage. For example, when the voltage from the sensor 68 exceeds a voltage corresponding to a desired target air/fuel ratio, the signal may be arranged to be "ON," while then the voltage output from the sensor 68 is less than the voltage at the target air/fuel ratio, the signal may be arranged to be "OFF."

In a given operating condition, the ECU 58 is arranged to set a desired air/fuel ratio, such as K1, with the target sensor voltage then M1 (i.e. if the sensor output passes through a wave-forming circuit, the output is arranged to indicate that the sensor is "ON" if the output voltage exceeds voltage M1, and arranged to indicate that the sensor is "OFF" if the output voltage is less than voltage M1). If the sensor output changes from a corresponding sensor output M1, then the ECU 58 is arranged to adjust the air/fuel ratio to bring it back to the desired value. For example, if the sensor indicates an output value M2 (indicating that the air/fuel mixture being supplied is too rich in fuel) then the ECU 58 is arranged to change the incoming air/fuel ratio to K2 (such as by shortening the fuel injection duration) to adjust the air/fuel ratio in the lean direction. Alternatively, if the sensor indicates an output value M1, then the ECU 58 is arranged to change the incoming air/fuel ratio to K3 in an attempt to bring the resultant conditions back to the desired value.

As discussed above, the presence of the platinum in the sensor 68 generally has the effect of causing the sensor output data to indicate an air/fuel ratio which is different than that which is actually in the cylinder after combustion. For example, at very high temperatures, oxygen is readily catalyzed by the platinum of the sensor 68, causing the sensor output to indicate that the air/fuel ratio is richer in fuel than that which was actually supplied. In that event, the ECU 58 utilizes the sensor data to erroneously change the ratio of air and fuel supplied to the engine 20 in the lean direction (i.e. K1 to K2). On the other hand, at low temperatures little catalyzation takes place and the ECU 58 may adjust the air and fuel ratio in the rich direction erroneously.

In accordance with the present invention, the target air/fuel ratio K1 is adjusted based on certain operating parameters to take into account changes in operating conditions which affect the output of the sensor 68 independent of changes in the air/fuel ratio. Preferably, the engine temperature $T_e$, intake air temperature $T_i$, and a fuel composition factor Q are utilized in adjusting the target air/fuel ratio.

Figure 4:
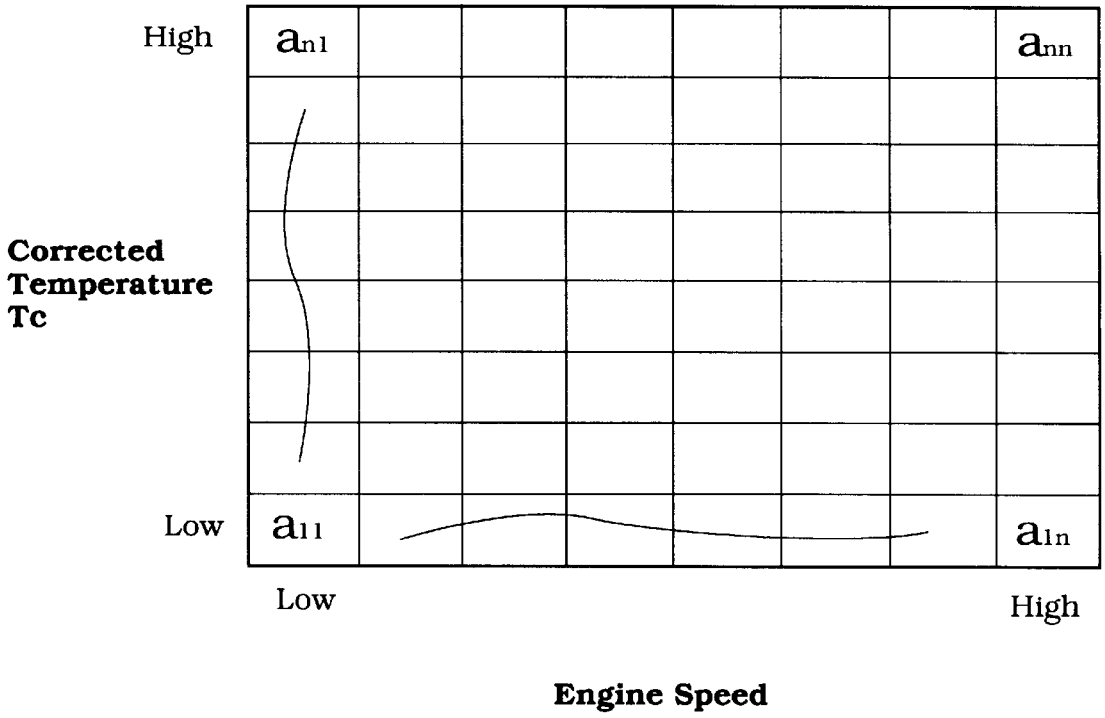
FIG. 4 is a graph which illustrates a memory map for the control of the present invention, with air/fuel ratio target data provided for various corrected temperatures T and engine speeds.

To keep the ECU 58 map memory small, an adjusted air/fuel ratio value is not provided under varying conditions for each of these parameters. Instead, and as illustrated in FIG. 4, a single air/fuel adjusted target value is provided for a variety of corrected temperature $T_c$ values at a number of engine speed values. Preferably, the corrected temperature $T_c=dT_e+eT_i+Q$, where d and e are positive constant factors. The factor Q may be adjusted by providing a signal from a fuel type switch (not shown) actuated by the operator or a fuel type sensor (such as to indicate that the fuel is oxygenated or non-oxygenated or other conditions affecting the air/fuel ratio).

The value $T_c$ is computed by the ECU 58 from the Q data, the engine temperature data from the sensor 66 and intake air temperature data from sensor 64. As illustrated, for a given corrected temperature $T_c$ at an engine speed, an adjusted target value am is provided. The ECU 58 utilizes this new target value, thus compensating for the above-described problems associated with the sensor 68. Once the new target value is selected, a corresponding target voltage associated with the output of the sensor 68 at the new air/fuel ratio may be provided, so that only when the sensor indicates a variation from this new target voltage are adjustments made to the air and fuel charge supplied to the engine 20.

As may now be understood, the control of the present invention is arranged to compensate for conditions which cause a change in sensor 68 output even when the actual air/fuel ratio within the combustion chamber does not change. In other words, at least one condition other than the air/fuel ratio which affects the output of the sensor is sensed so that the output of the oxygen sensor 68 may be adjusted for inaccuracies caused by that condition. In the above-described embodiment, the engine temperature, intake air temperature and fuel type are sensed. As may be appreciated by those skilled in the art, other conditions may be sensed as well. While the data from the sensed condition(s) which affects the output of the sensor (even when the air/fuel ratio does not change) is used to change a target air/fuel ratio in the preferred embodiment of the present invention, the data may be used to correct or compensate for changes in the output of the sensor 68 in other manners. For example, when the output of the oxygen sensor 68 is in the form of a varying voltage, a signal from the sensor sensing the condition affecting the sensor output may be applied to that signal to produce a "corrected" signal which is supplied to the control for adjusting the air/fuel ratio.

Figure 5A:
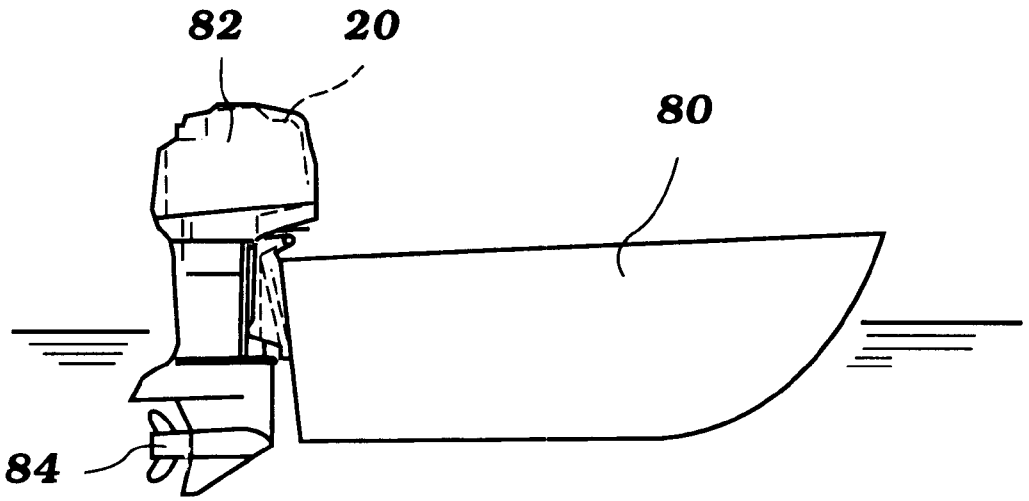
FIG. 5(*a*) illustrates a watercraft propelled with an outboard motor powered by an engine of the type having a control system with a sensor arranged in accordance with the present invention, the watercraft in a non-planed position.
Figure 5B:
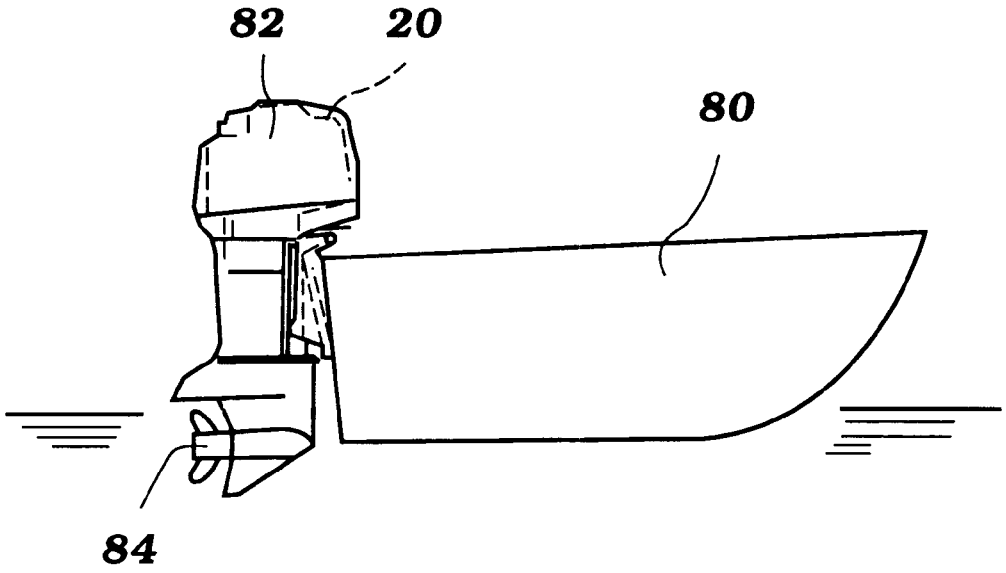

A particular application of an engine 20 having the engine control of the present invention is illustrated in FIGS. 5(*a*) and (*b*). These figures illustrate a watercraft 80 propelled by an outboard motor 82. The engine 20 is mounted in a cowling of the motor 82 and arranged to drive a water propulsion device 84 thereof. The motor 82 is used to propel the craft 80 from a regular operating state (FIG. 5(*a*)) to a planed state (FIG. 5(*b*)).

It will be understood to those of skill in the art that the engine control of the present invention may be used with an engine in a variety of other applications.

In the embodiment described above, a single oxygen sensor 68 is provided for sensing the combustion condition in a single combustion chamber of a multi-cylinder engine. As may be appreciated by those of skill in the art, the sensor 68 may be arranged to sense the combustion products associated with more than one combustion chamber (as in an exhaust system of the engine), and/or more than one sensor may be provided, such as one for sensing the combustion condition associated with each combustion chamber.

Of course, the foregoing description is that of preferred embodiments of the invention, and various changes and modifications may be made without departing from the spirit and scope of the invention, as defined by the appended claims.

What is claimed is:

1. A control for an internal combustion engine, said engine comprising a combustion chamber, an air/fuel charging system for delivering an air and fuel charge to said combustion chamber for combustion therein, said control including a combustion condition sensor associated with said combustion chamber for sensing an oxygen content of combustion products in said combustion chamber and providing an output signal indicative of the air/fuel ratio of said charge supplied to said combustion chamber and means for sensing a condition other than said oxygen content which affects the output of said sensor such that it does not provide a signal indicative of the actual air/fuel ratio, said control arranged to change an air/fuel ratio of said air and fuel charge supplied to said combustion chamber based upon said output of said sensor as corrected by an output supplied by said means for sensing a condition selected from the group of intake air temperature and the type of fuel supplied by said air/fuel charging system.

2. The control for an internal combustion engine in accordance with claim 1, wherein said means for sensing senses a temperature of said air delivered to said combustion chamber.

3. The control for an internal combustion engine in accordance with claim 1, wherein said control includes a feedback control which includes means for adjusting said air/fuel ratio of said charge supplied to said combustion chamber.

4. A control for an internal combustion engine, said engine comprising, a combustion chamber, an air/fuel charging system for delivering an air and fuel charge to said combustion chamber for combustion therein, said control including a combustion condition sensor associated with said combustion chamber for sensing an oxygen content of combustion products in said combustion chamber and providing an output signal indicative of the air/fuel ratio of said charge supplied to said combustion chamber and means for sensing a condition other than said oxygen content which affects the output of said sensor such that it does not provide a signal indicative of the actual air/fuel ratio, said control including a feedback control which includes means for adjusting said air/fuel ratio of the charge delivered to said combustion chamber towards a target value to change an air/fuel ratio of said air and fuel charge supplied to said combustion chamber based upon said output of said combustion condition sensor, and wherein said target value is changed dependent upon an output of said means for sensing a condition.

5. The control for an internal combustion engine in accordance with claim 4, wherein said means for sensing senses at least a temperature of said engine and a temperature of intake air and wherein said feedback control includes a map of target values dependent upon engine speed and a correction factor dependent upon said temperature of said air and said engine.

6. A control for an internal combustion engine, said engine comprising a combustion chamber, an air/fuel charging system for delivering an air and fuel charge to said combustion chamber for combustion therein, a combustion condition sensor associated with said sensor providing an output signal indicative of the air/fuel ratio of said charge supplied to said combustion chamber, feedback control means for adjusting the air/fuel ratio of the charge delivered to said combustion chamber towards a target value based upon the output of said combustion condition sensor, said feedback control means including means for adjusting said target value based upon at least one engine operating condition which changes an output of said sensor regardless of a change in air/fuel ratio of said charge, said at least one operating condition comprising intake air temperature.

7. The control in accordance with claim 6, wherein said at least one operating condition further comprises engine temperature.

8. The control in accordance with claim 6, wherein said target value is adjusted based on intake air temperature and engine temperature.

9. A method of controlling the ratio of an air and fuel charge supplied to a combustion chamber of an engine comprising the steps of setting an air/fuel ratio target value, providing an air/fuel mixture to said combustion chamber, said air/fuel mixture having an air/fuel ratio, obtaining air/fuel ratio data from a sensor associated with said combustion chamber, sensing at least one engine operating condition affecting the data provided by said sensor selected from the group of intake air temperature and the type of fuel supplied to said engine, and adjusting said target value based upon said sensed operating condition.

10. The method in accordance with claim 9, wherein said step of sensing at least one engine operating condition comprises the step of sensing a temperature of air supplied to said combustion chamber.

11. The method in accordance with claim 9, wherein said step of sensing at least one engine operating condition comprises the step of sensing a temperature associated with said engine.

12. The method in accordance with claim 9, further including the step of providing adjusted target values based upon engine speed and a value obtained from said sensing said at least one engine operating condition.

* * * * *